US011156007B2

(12) United States Patent
Quiles-Perez

(10) Patent No.: US 11,156,007 B2
(45) Date of Patent: Oct. 26, 2021

(54) SECURE HOLDING SPACER UNITS FOR PERMANENT FORMWORKS

(71) Applicant: Pedro Juan Quiles-Perez, San Juan, PR (US)

(72) Inventor: Pedro Juan Quiles-Perez, San Juan, PR (US)

( * ) Notice: Subject to any disclaimer, the term of this patent is extended or adjusted under 35 U.S.C. 154(b) by 0 days.

(21) Appl. No.: 16/535,645

(22) Filed: Aug. 8, 2019

(65) Prior Publication Data

US 2020/0071943 A1 Mar. 5, 2020

(51) Int. Cl.
*E04G 17/075* (2006.01)

(52) U.S. Cl.
CPC ..... *E04G 17/0754* (2013.01)

(58) Field of Classification Search
CPC ..... E04G 17/0754; E04B 2/8635
See application file for complete search history.

(56) References Cited

U.S. PATENT DOCUMENTS 842,722 A * 1/1907 Swinnerton ..... E04G 17/0714 249/43
1,875,463 A * 9/1932 Jones ..... E04G 17/0754 249/45
2,076,473 A * 4/1937 London ..... E04B 2/8635 52/426
2,160,489 A * 5/1939 Spies ..... E04G 17/06 52/701
3,181,832 A * 5/1965 Augustine ..... E04G 17/0714 249/43
3,314,207 A * 4/1967 Sigl ..... E04B 2/8635 52/428
3,625,470 A * 12/1971 Shoemaker ..... E04G 17/0721 249/214
3,985,329 A * 10/1976 Liedgens ..... E04B 2/8647 249/40
5,107,648 A * 4/1992 Roby ..... E04B 2/8647 52/309.12
5,570,550 A * 11/1996 Roby ..... E04B 2/8647 52/309.12
6,832,456 B1 * 12/2004 Bilowol ..... E04G 9/02 52/426
8,468,764 B2 * 6/2013 Degen ..... E04B 2/8635 52/489.1
8,720,160 B1 * 5/2014 Cooper ..... E04B 2/8629 52/745.12

(Continued)

*Primary Examiner* — Rodney Mintz
(74) *Attorney, Agent, or Firm* — Hoglund & Pamias, PSC; Roberto J. Rios

(57) ABSTRACT

The instant invention provides a secure holding spacer unit to be used when assembling permanent stay-in-place formworks, also known as "permanent stay-in-place molds", which are commonly used for the construction of concrete structures by putting together two boards or panels held together by a series of holding spacer units that are securely attached or hold to the surfaces of the cement panels by fastening means that pass through the width of the panels. The holding spacer units are selectively distributed within the internal cavity of the formwork and are attached to the panels, and are designed so that the panels remain permanently attached to the units of the spacers, to restrict the outward movement of said panels when pouring the concrete mix in the unit, which results in a permanent formwork with smooth exterior surfaces.

23 Claims, 14 Drawing Sheets

(56) References Cited

U.S. PATENT DOCUMENTS

| | | | | |
|---|---|---|---|---|
| 8,997,421 | B2 * | 4/2015 | Del Pino Garcia | E04B 2/8647 52/426 |
| 9,388,574 | B2 * | 7/2016 | Ryan | E04B 2/8641 |
| 9,695,589 | B2 * | 7/2017 | Dixon | E04C 2/044 |
| 9,725,867 | B2 * | 8/2017 | Van De Loo | E04C 5/16 |
| D821,856 | S * | 7/2018 | Burns | E04B 2/8641 D8/380 |
| 10,513,859 | B2 * | 12/2019 | Ryan | E04B 2/8641 |
| 2010/0229482 | A1 * | 9/2010 | Lee | E04C 3/46 52/223.8 |
| 2011/0131892 | A1 * | 6/2011 | Del Pino | E04B 2/8635 52/125.4 |
| 2011/0265413 | A1 * | 11/2011 | Del Pino Garcia | E04B 2/8647 52/426 |
| 2011/0314760 | A1 * | 12/2011 | Degen | E04B 2/8635 52/426 |
| 2012/0137613 | A1 * | 6/2012 | Schurmann | E04B 2/8635 52/426 |
| 2012/0233950 | A1 * | 9/2012 | Carr | E04C 3/34 52/426 |
| 2014/0007537 | A1 * | 1/2014 | Perez | E04B 2/8635 52/426 |
| 2015/0068146 | A1 * | 3/2015 | Dixon | E04C 2/044 52/425 |
| 2015/0275462 | A1 * | 10/2015 | Van De Loo | E04C 5/00 52/223.14 |
| 2016/0168849 | A1 * | 6/2016 | Ryan | E04B 2/8641 52/404.2 |

* cited by examiner

SECURE HOLDING SPACER UNITS FOR PERMANENT FORMWORKS

TECHNICAL FIELD OF THE INVENTION

This invention relates to secure holding spacer units useful in the assembling of permanent formworks suitable for the construction of concrete structures. More particularly, the invention refers to secure holding spacer units that are capable of providing steadiness and resistance to permanent formworks, which are beneficial in the construction of monolithic concrete structures of exceptional strength.

BACKGROUND OF THE INVENTION

For many years, temporary and/or permanent (stay-in-place) formworks made of timber and plywood, steel, aluminum and plastic, or composite of cement and foam insulation, or composite of cement and wood chips, among others materials, have been a part of the process of building concrete structures. The principal advantage of building concrete structures using temporary and/or permanent formworks, when compared with the traditional use of beam or modular formworks, is the notable reduction of labor time and construction costs.

Since the early 1900's, fiber cement panels, also generally known as "fiber cement boards" or "cementitious panels", among other designations, have been also used in the elaboration of permanent formworks. Those fiber cement formworks have proven to be advantageous in the construction of concrete structures. In general terms, two fiber cement panels are vertically positioned and held together by diverse means, in order to form a hollow space, making a formwork of certain predetermined width, intended to be filled with a liquid concrete mixture, at the construction site. Such type of formworks stay in place after the concrete mix has dried and provides advantages in terms of speed, strength, as well as thermal and sound insulation, also letting inside space to run necessary mechanical components for utilities and construction rods.

Over the years, the real challenge in the production and use of such permanent formworks has been to be able to keep both cement fiber panels firmly attached, so that they do not yield when the concrete mixture is poured inside and so it also permits to obtain across the formworks, inner pressure of great resistance.

In most instances, to prepare the formworks, said fiber cement panels are grasp together by means of vertical and horizontal, as well as other kinds of structural components, which are internally and/or externally attached and/or glued to the panels, resulting frequently, in a weak structure. The resulting lack of stability hinder the construction process, commonly demanding the use of external supports to offset or to provide additional stability to the internal pressure created once the liquid concrete mixture is poured inside the formwork. Likewise, said external components difficult the alignment and proper connection of the individual formworks, as required for the construction of larger structures.

Moreover, the use of multiple complex components assembled through the width of the fiber cement boards and the process of passing along its internal hollow cavity, jeopardize the firmness and stability of the assembled formwork, as well as the strength of the structure constructed with said formwork. Such components occupy a large area of the internal cavity and thus, and recurrently form obstructions that hinder the uniform contact and distribution of the liquid concrete mixture poured in within the formwork, interrupting or delaying the concreting operations, allowing the formation of cold joints, then resulting, in a non-monolithic and weak concrete structure. Externally, once the concrete structure is made, it is necessary to eliminate or disassemble the external section of such components, which results in additional work time and costs.

Hence, there is a need for a secure holding spacer unit that allows, in a practical, easy and friendly way, to assemble permanent fiber cement formworks, as well as provides stability to the formwork, which also allows the insertion of common mechanical construction elements through the formwork, such as construction rods, as well as electrical and plumbing elements, which is specially designed to increase the stability of the assembled formwork, which is capable of allowing the uniform dispersion of the internal pressure created by the liquid concrete mixture poured into the formwork, without letting the panels break and/or yield, as well as that is capable of allowing the uniform and constant contact of the liquid concrete mixture throughout the internal formwork cavity, thus avoiding the creation of joints cold, so that concrete structures of excellent strength and resistant can be attained.

OBJECTS AND SUMMARY OF THE INVENTION

It is an object of the invention to provide secure holding spacer units which can ensure that assembled permanent fiber cement formworks are capable of securely hold its fiber cement panels with strong firmness, wherein the secure holding spacer units are distributed exclusively in small areas of the formwork and strongly secured to the fiber cement panels, without having any of their components exposed at the exterior surfaces of the panels. Another object of the invention is to provide permanent formworks made of cementitious panels with exceptional resistance to the internal pressure that creates the effect of pouring the liquid concrete mixture in the formwork cavity, so it is capable to stand such internal pressure without the need of adding to the assembled formworks any additional external supports or components.

Yet another object of the invention is to provide a permanent formwork wherein the liquid concrete mixture is uniformly and evenly distributed inside its internal cavity, allowing said concrete mixture to form strong monolithic structures when the concrete dries. Another object of the instant invention is that it allows the complete cure of the concrete in the recommended time, different from the traditional means where it is necessary to remove the panels at some point, stopping or interrupting the normal setting process of the concrete, providing then an optimal setting process to the concrete structure. Still another object of the invention is to provide strong fiber cement formworks that are able to be firmly interconnected to other formworks, in order to produce uniform and strong larger size concrete structures. Yet another object of the invention is to provide formworks that can result in the construction of concrete structures that resists high pressure and heavy weights. Another object of the instant invention is to make available permanent cementitious formworks having its exterior surface substantially flat, so when it is poured with the concrete mixture and dries, it results in a solid concrete structure already having flat external surfaces, with no need of being further plastered with cement to smooth the external surface. In yet another object of the invention is to provide permanent cementitious formworks wherein distance and distribution of re-bars may be easily predetermined and pre-established as demanded by or according to a given or particular construction code.

BRIEF DESCRIPTION OF THE DRAWINGS

The foregoing and additional features and characteristics of the representations of the present invention will become more apparent from the following detailed description considered with reference to the accompanying drawings, which are used herein in a manner of example only, and wherein.

DETAILED DESCRIPTION OF THE EMBODIMENTS

The following detailed description explains the invention by way of example and is not limited to the particular limitations presented herein as principles of the invention. This description is directed to enable one skilled in the art to make and use the invention by describing embodiments, adaptations, variations and alternatives of the invention potential variations of the limitations herein described are within the scope of the invention. Particularly, the size and shapes of some of the invention's elements illustrated in the discussion may be varied and still provide formworks or molds having different sizes or geometric shapes, that are within the scope of the instant invention.

In general terms, the purpose of the instant invention is to produce secure holding spacer units that are useful in the manufacture of stay-in-place construction formworks or molds.

Figure 1A:
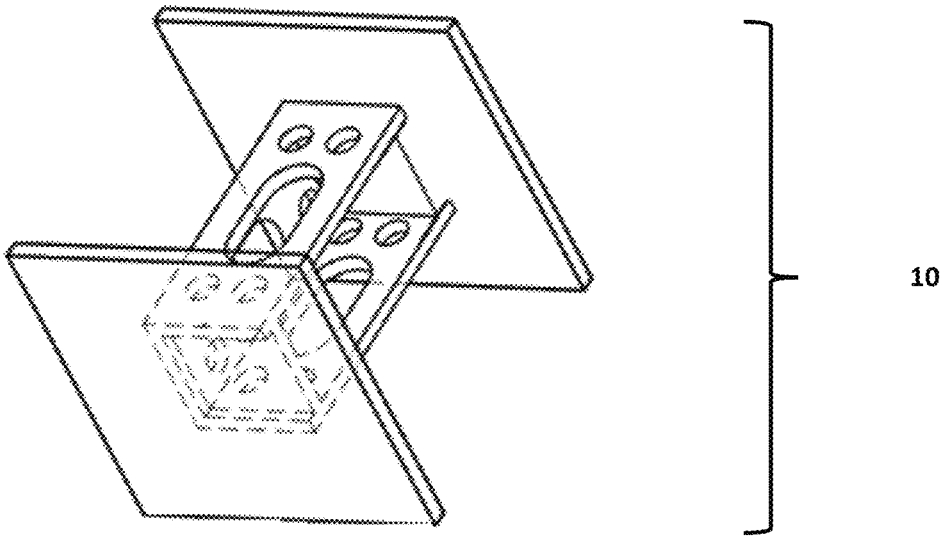
FIGS. 1A and 1B display different representations and perspectives of the holding spacer unit according to the instant invention, being the same a one piece, complete and compact, plastic holding spacer unit.
Figure 1B:
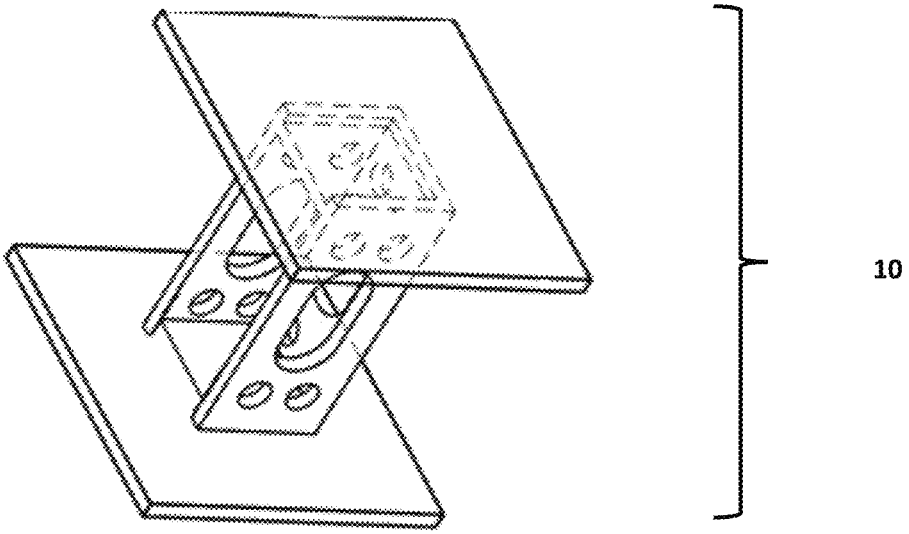
Figure 2A:
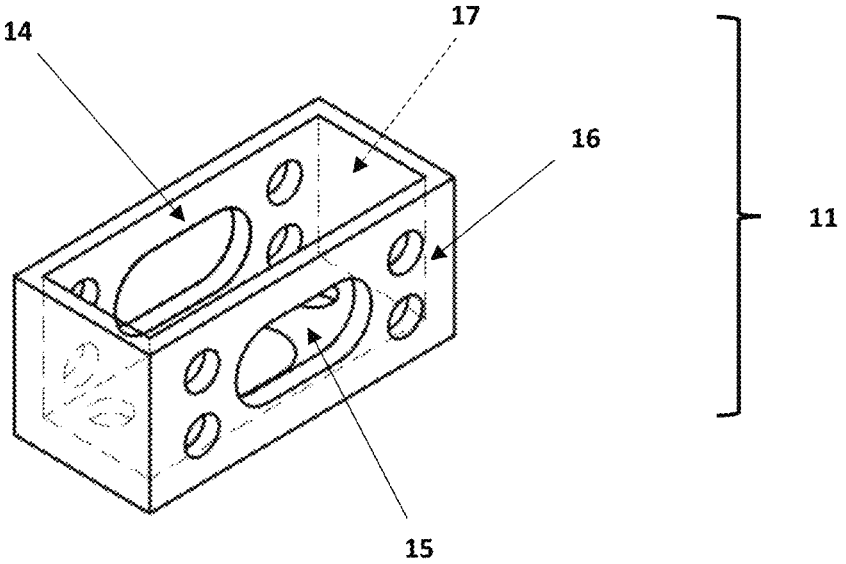
FIGS. 2A and 2B illustrate different views of the central area of the holding spacer unit, which is made of plastic, of a rectangular cuboid form and encompass six facets in total, four of which facets are of a rectangular shape and two of which facets are of a square shape. Three of those four rectangular shaped facets, have five holes. Four of those holes are of identical size and of circular shape. The fifth hole, which is bigger that the circular holes and is located in the middle of the rectangular shaped facet, is of an oblong shape. The fourth rectangular shaped facet is completely open. The two square shaped lateral facets of the central area of the holding spacer unit, have no holes on them.
Figure 2B:
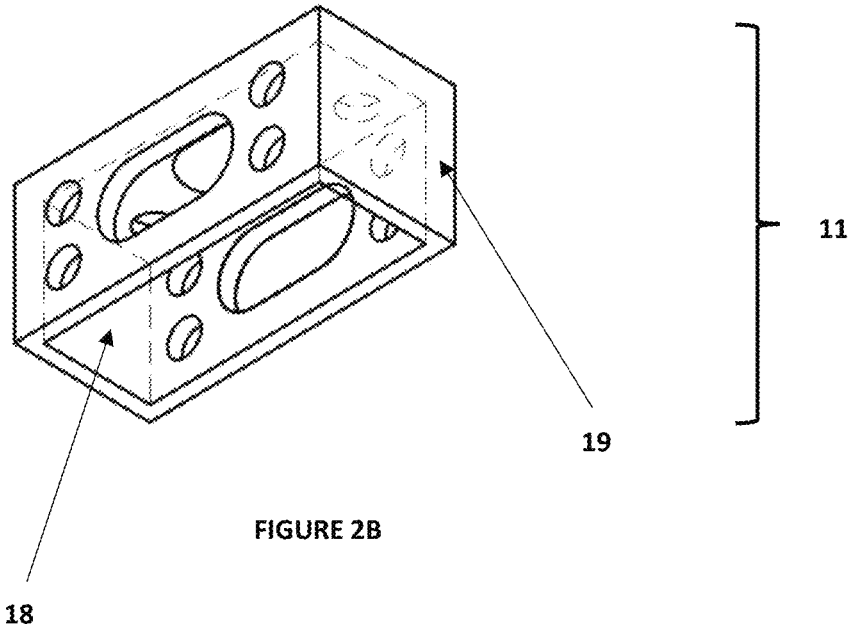
Figure 5A:
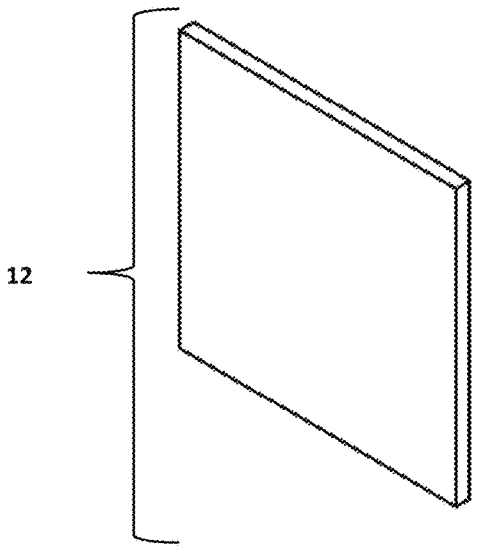
FIGS. 5A and 5B show different views of the two lateral areas of the holding spacer unit, which are also made of plastic, of a square shape, and which are fused with and form together, in conjunction with the central area of rectangular cuboid form of the holding spacer, a one piece, complete and solid, plastic holding spacer unit.
Figure 5B:
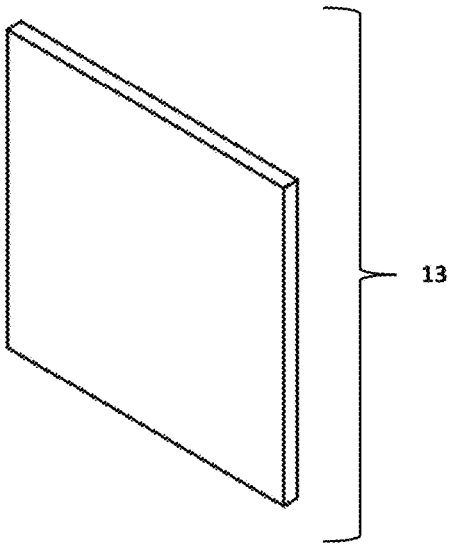
Figure 6:
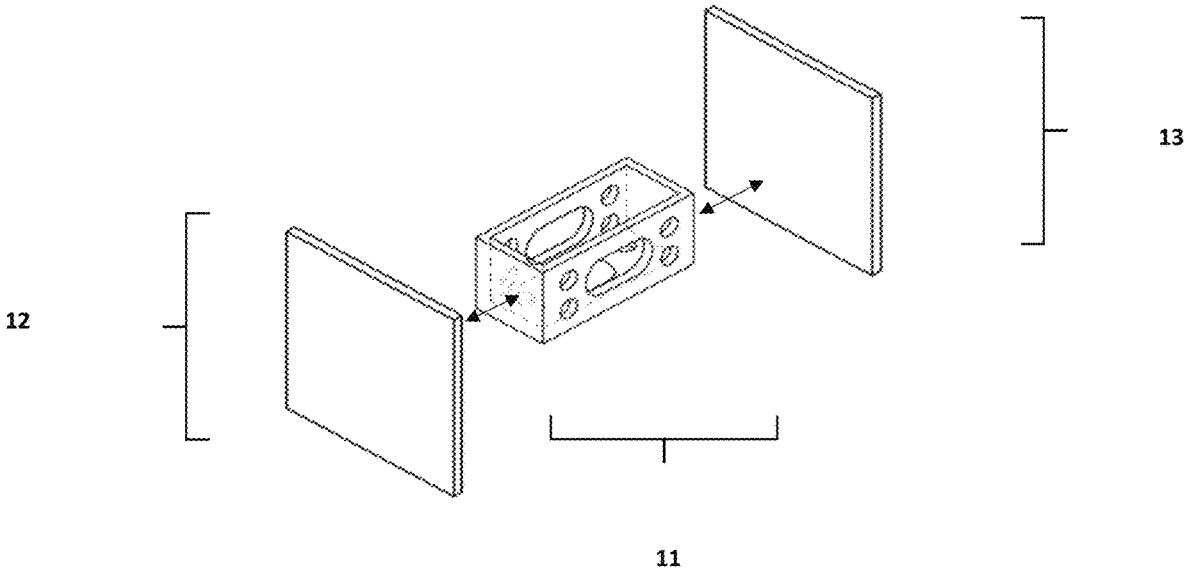
FIG. 6 display how the central area of rectangular cuboid form in conjunction with the lateral areas of the instant invention that are fused together, forming a single, complete and solid plastic holding spacer unit, meant to be used to manufacture stay-in-place formworks.
Figure 7:
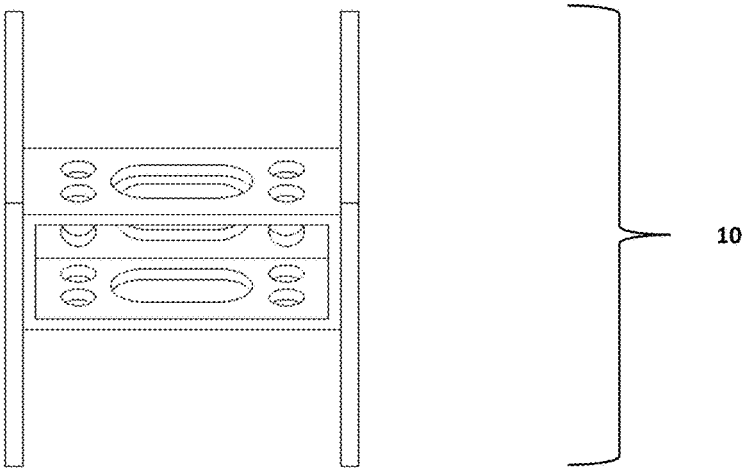
FIG. 7 illustrate the instant invention, which is a one piece, complete, solid and compact, plastic holding spacer unit.

Essentially, the instant invention herein described and shown in FIGS. 1A and 1B is a one piece, complete, solid and compact, plastic holding spacer unit 10 which entails one central component or area 11 shown in FIGS. 2A and 2B, fused with two lateral components 12 and 13 shown in FIGS. 5A and 5B.

Figure 4A:
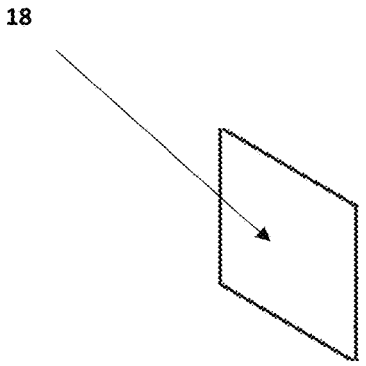
FIGS. 4A and 4B display views of the two square shaped lateral facets of the central area of the holding spacer unit.
Figure 4B:
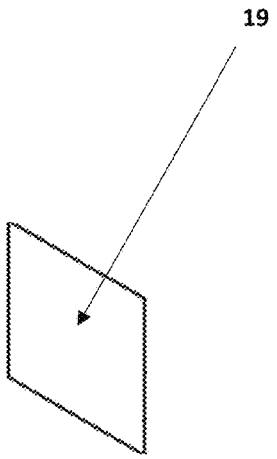

The central component or area 11, shown in FIGS. 2A and 2B, is a hollow piece of a rectangular cuboid form, having six facets in total 14, 15, 16, 17, 18 and 19, four of which facets are of a rectangular shape 14, 15, 16 and 17, and two of the facets, shown in FIGS. 4A and 4B, which are squared shape 18 and 19.

Figure 3A:
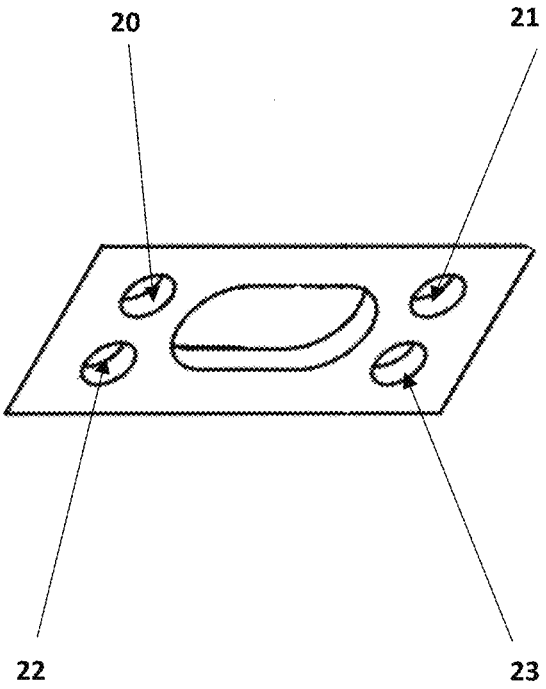
FIGS. 3A, 3 B and 3C demonstrate different representations and perspectives of the three rectangular shaped facets of the central area of the holding spacer unit, as well of the holes that are part of those facets.
Figure 3B:
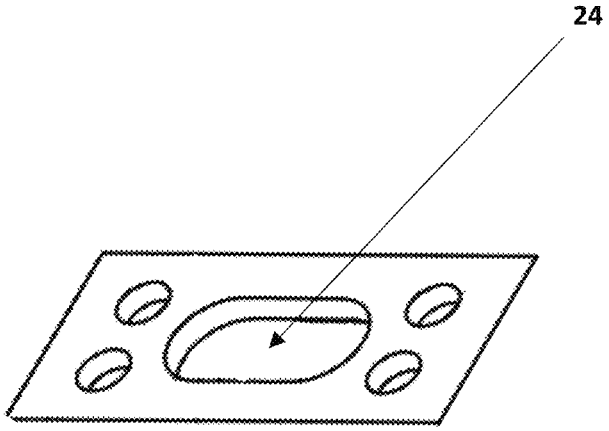
Figure 3C:
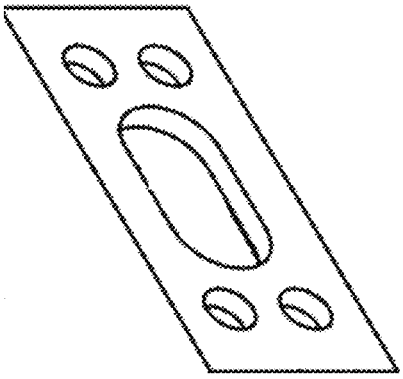

Three of the four rectangular shaped facets 14, 15 and 16, have five holes 20, 21, 22, 23 and 24, as shown in FIGS. 3A, 3B and 3C. Four of those holes are of identical size and of circular shape 20, 21, 22 and 23. The fifth hole 24, is located in the middle of such rectangular shaped facet and is of an oblong shape, as well as bigger than the four circular holes 20, 21, 22 and 23. The fourth rectangular shaped facet 17, shown in FIG. 2A, is completely open.

The two square shaped facets 18 and 19 of the central area 11 of the holding spacer unit 10, and shown in FIGS. 4A and 4B, have no holes on them.

Figure 8A:
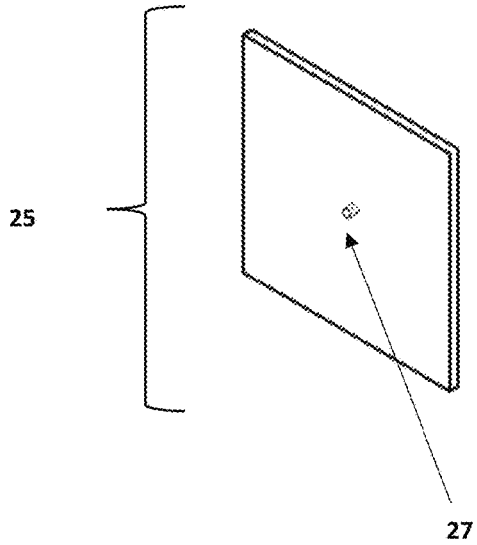
FIGS. 8A and 8B display different views of two square shaped metal plates having each a small single pilot hole in the center, which are placed in the external faces of the cementitious panels when installing the instant invention as part of the assembly process of a formwork.
Figure 8B:
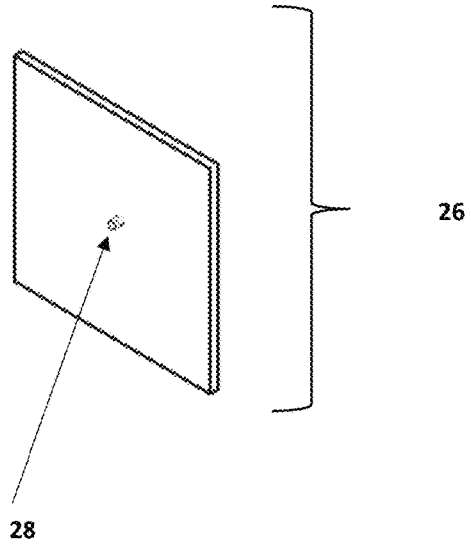
Figure 9A:
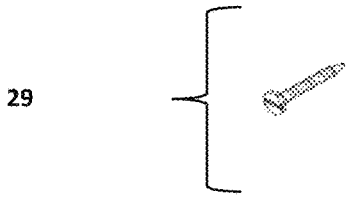
FIGS. 9A and 9B display self-drilling galvanized steel screws that are inserted through the small single pilot holes of the square shaped metal plates and that are used to secure each lateral side of the holding spacers units to each one of the two cementitious panels used to assemble each formwork.
Figure 9B:
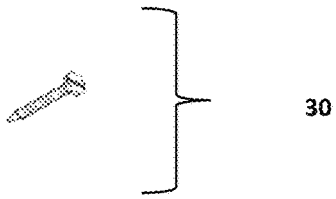
Figure 10:
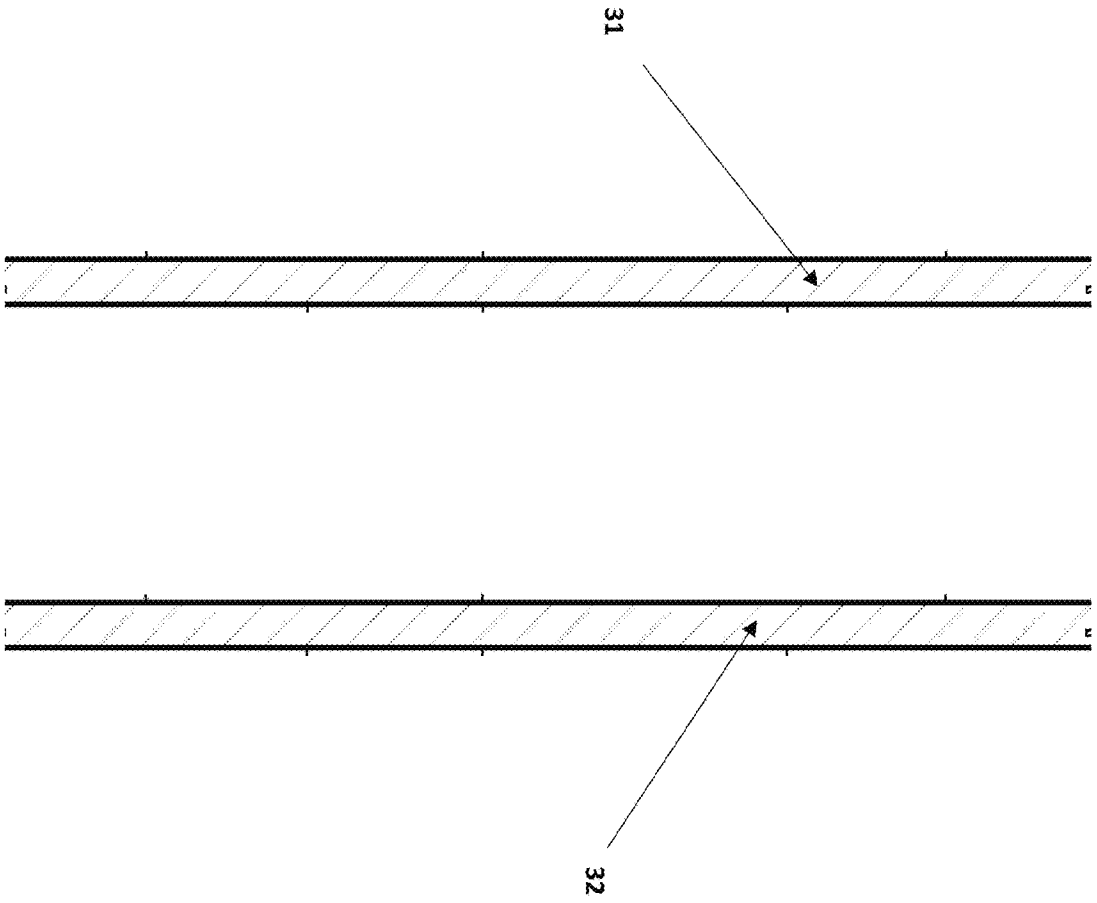
FIG. 10 illustrate a side view of two typical fiber cement panels used for construction purposes and that are combined with the instant invention as part of the process of assembly of permanent formworks.

The method in which the spacer holding unit 10 is secured to the cementitious panels when assembling the formworks or molds, is through the use of two additional parts. Those two additional parts, shown in FIGS. 8A and 8B, are two squared shape metal plates 25 and 26 with a small pre-drilled hole in their center 27 and 28 and two self-drilling galvanized steel screws 29 and 30, shown in FIGS. 9A and 9B.

Figure 11:
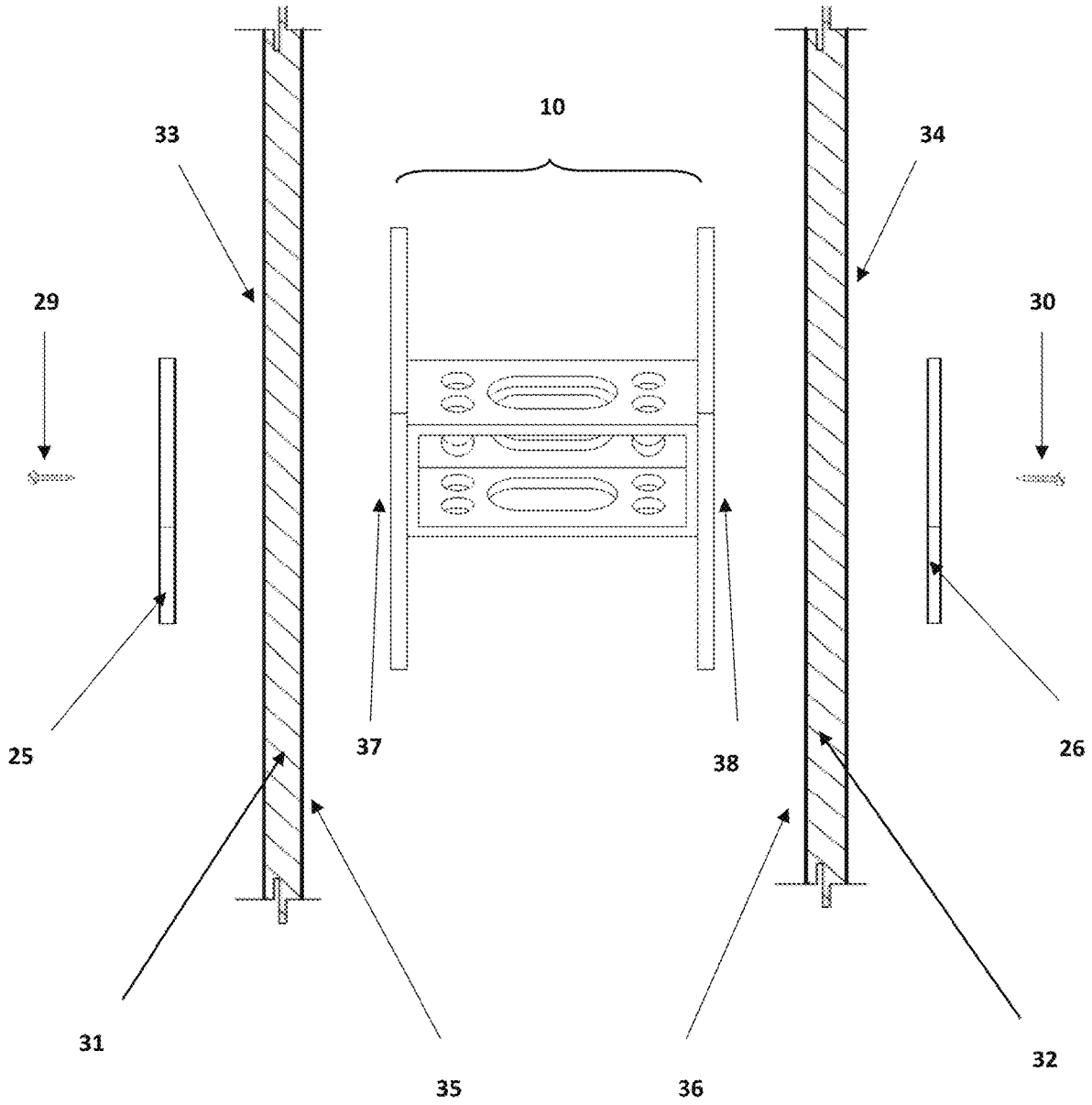
FIGS. 11, 12 and 13 display varied views of the different components of the instant invention and how, in conjunction with two fiber cement panels, the holding spacer unit is secured to the cementitious panels, with the self-drilling galvanized steel screws passing through the holes of the squared shaped metal plates, when drilled from the exterior part of the formwork to its interior, allowing them to break through the width of the cementitious panels, until they reach and pierce the lateral side of the spacer holding unit, resulting in a spacer holding unit, safely attached and secured, both from the exterior side, as well as from the interior side, of the cementitious panel.
Figure 13:
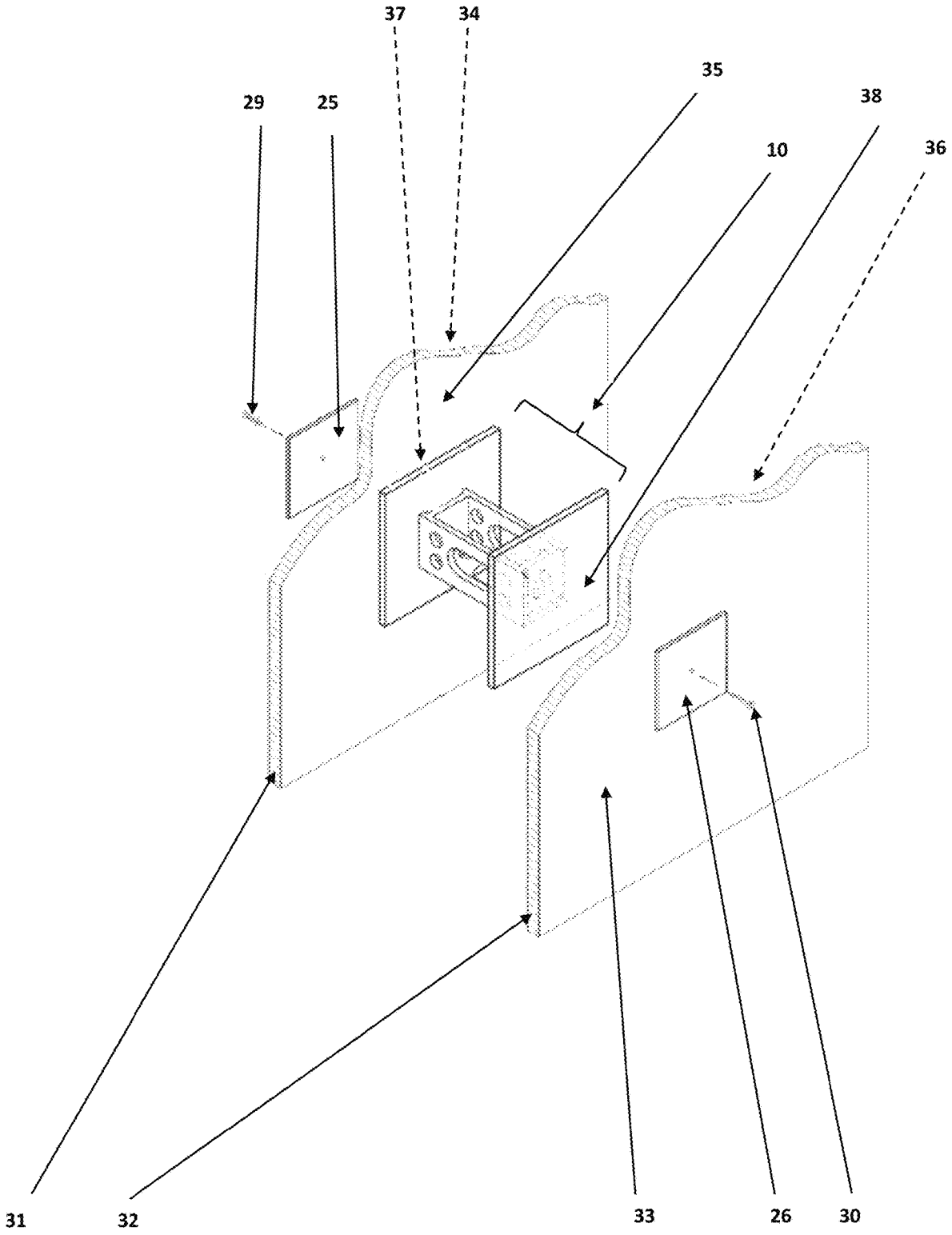

As shown in FIGS. 11 and 13, the two squared shape metal plates 25 and 26 are positioned against the outside faces 33 and 34 of the cementitious boards 31 and 32, opposite to the lateral sides 37 and 38 of the spacer holding unit 10, which are placed against on the interior faces 35 and 36 of the cementitious boards 31 and 32, forming a hollow space 39 (shown in FIG. 11), among the two cementitious panels 31 and 32. Then, the metal self-drilling galvanized steel screws 29 and 30 are passed through the small pre-drilled holes 27 and 28 at the center of the squared shape metal plates 25 and 26, penetrating the inside of the cementitious panels 31 and 32 until they reach and also penetrate the lateral sides 37 and 38 of the spacer holding unit 10 which are placed opposite to the metal plates 25 and 26, tightly securing the spacer holding unit 10 to both cementitious panels 31 and 32, creating a secure interconnection, so that the spacer holding unit 10 is embraced between the two cementitious boards 31 and 32.

Figure 17:
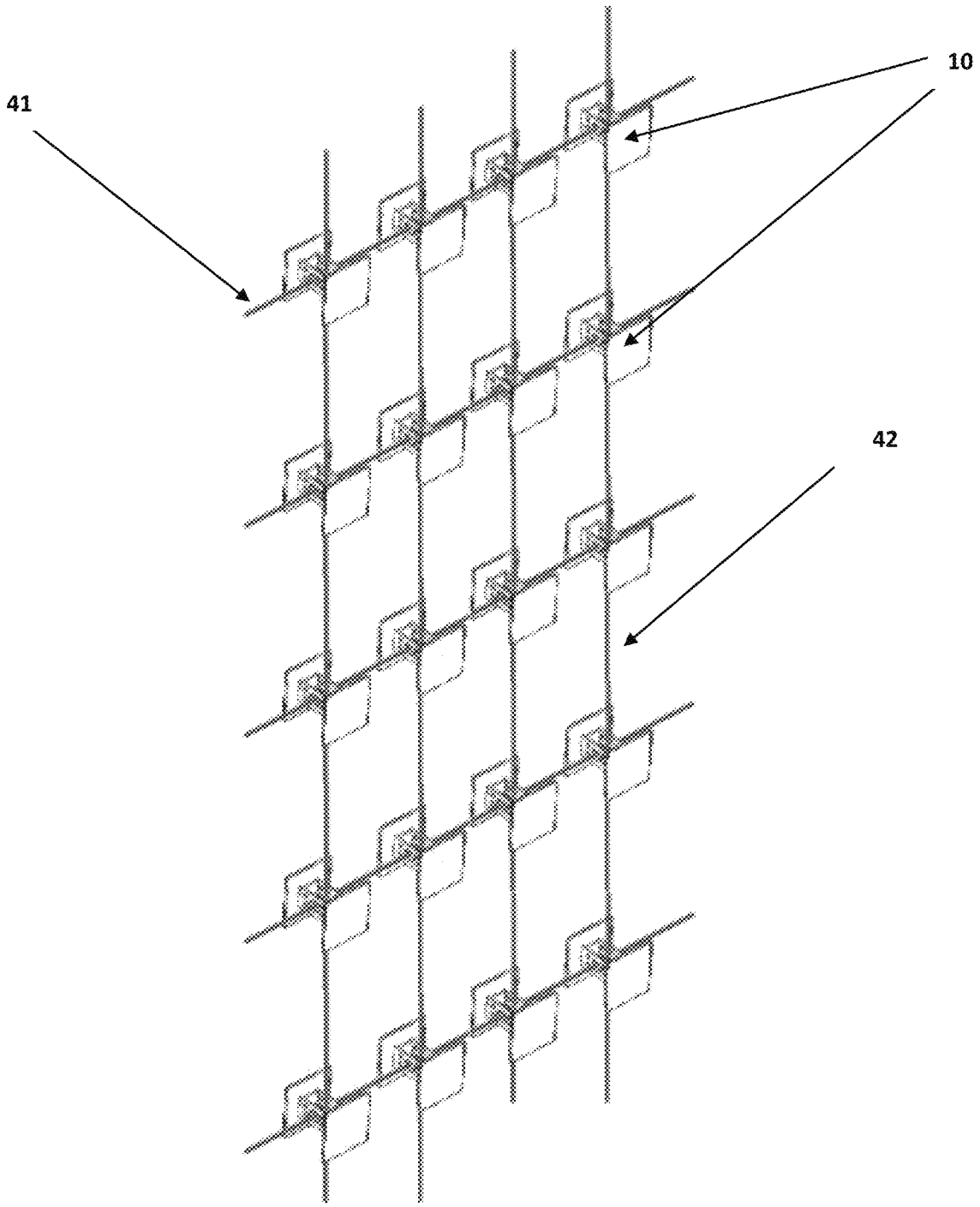
FIG. 17 illustrates the insertion of construction rods, vertically and horizontally, into the formwork, through the oblong holes of the rectangular shaped facets of the central area of the spacer holding units, resulting in a grid patterned engaging which is required to subsequently create a reinforced concrete structure when the concrete mix gets poured inside the formwork.
Figure 18A:
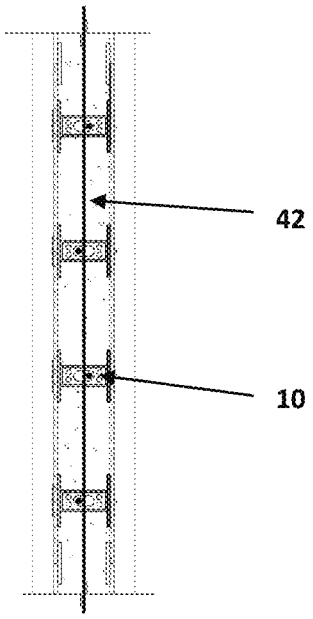
FIGS. 18A and 18B depicts additional views from the side (FIG. 18 A) and from above (FIG. 18B) of assembled cementitious formworks, showing how the construction rods are passed through the oblong holes of the rectangular shaped facets of the central area of the spacer holding units.
Figure 18B:
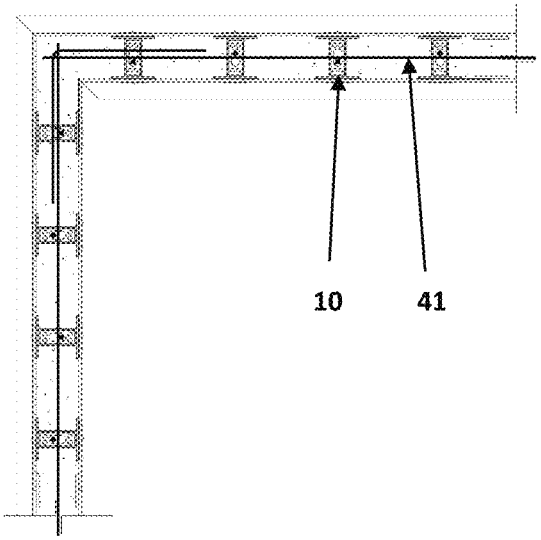
Figure 19:
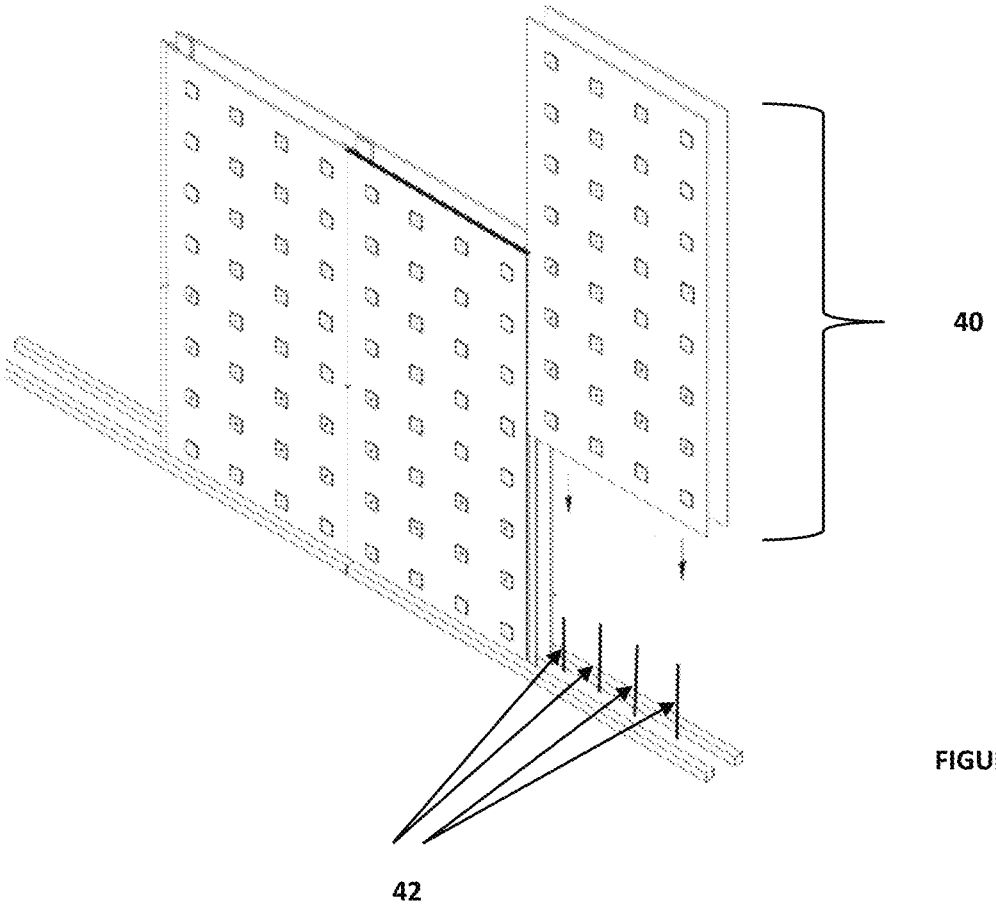
FIG. 19 display various formworks or molds assembled using the secure holding spacer units to form a concrete wall.
Figure 20:
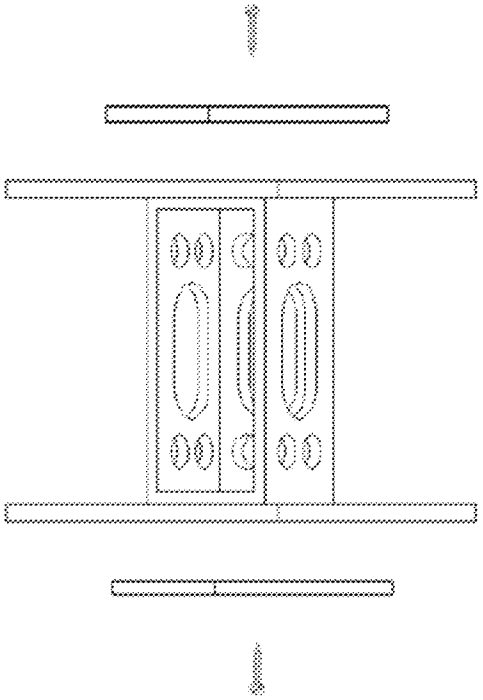
FIG. 20 display all the components of the secure holding spacer units.

The purpose of the oblong shaped holes 24 present in three rectangular shaped facets 14, 15 and 16 of the four rectangular shaped facets 14, 15, 16 and 17, of the central component or area 11 of the secure holding spacer unit 10 is to allow an easy insertion and or the relaxed passage and inset through them of other necessary interior common mechanical construction elements, such as construction rods 41 and 42 shown on FIG. 17, as well as power and plumbing pipes.

The role of the four circular shaped holes 20, 21, 22 and 23 present in three rectangular shaped facets 14, 15 and 16 of the central component or area 11 of the secure holding spacer unit 10, as well as of the complete opening of the fourth rectangular shaped facet 17 of such central component or area 11, is to allow the easy and uniform passage of the concrete mixture inside the built formwork or mold, and to avoid the formation of a cold joint in the interior of the concrete structure.

Figure 12:
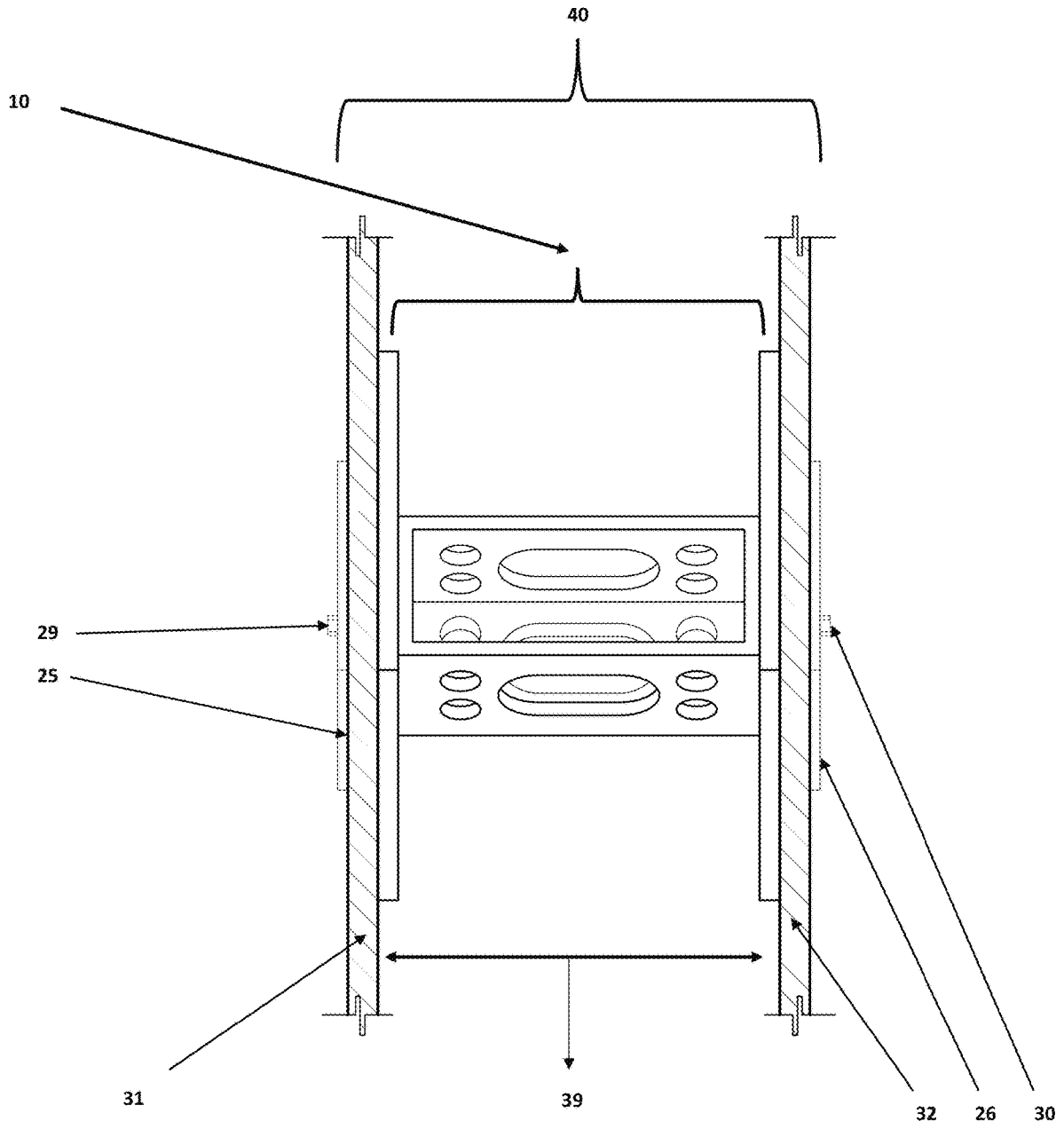

The particular dimensions of the spacer holding unit 10, the amount of spacer holding units needed for each formwork or mold to be assembled, as well as their particular position in the hollow space 39 (FIG. 12) created between the two cementitious boards 31 and 32, may vary depending in different factors, such as the size of the desired formwork or mold, the width of the structure to be constructed with the formwork, the size of horizontal and vertical construction bars 41 and 42 (FIG. 17) to be introduced in the formwork during the construction process and other construction specifications dictated by particular legal constructions codes.

Figure 14:
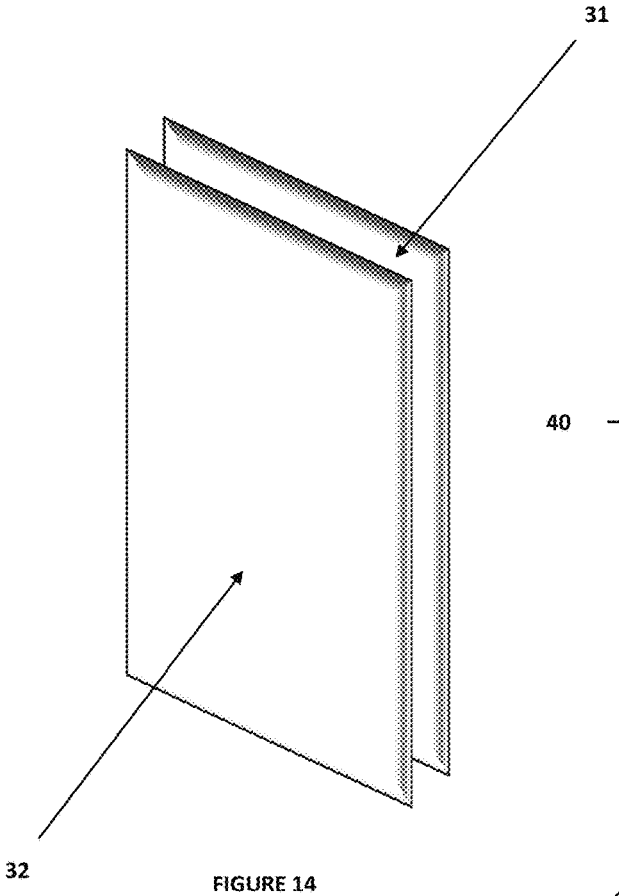
FIG. 14 display a partial view of typical fiber cement panels used for construction purposes, as part of the assembly of permanent formworks using the instant invention.

As illustrated in FIG. 14, in one of the preferred embodiment of the holding spacer units 10 used with fiber cement boards 31 and 32 having dimensions of 4 feet per 8 feet, the holding spacer unit 10 may have a length of 5.0 inches which, each one of the two fiber cement boards 31 and 32 may have a thickness of 0.5 inches each, thus providing a permanent formwork of a total width of 6 inches.

As explained in further details below, the holding spacer unit 10 is used in the assemblage of formworks or molds particularly designed to be fill out with liquid concrete mixture during the building process of structures. Among other main functions of the holding spacer unit 10 are providing excellent structural strength inside the formworks or molds capable to withstand extreme internal pressures created by the concrete mixture until it solidifies.

Additionally, said secure spacer holding unit 10 provides support to construction rods 41 and 42 (FIGS. 17, 18A, 18B and 19) that can be horizontally and/or vertically arranged, as required by any given particular structural specification.

The square shaped metal plates 25 and 26 used as part of the holding spacer unit 10 are positioned against the outer faces 33 and 34 of the cement boards, which on its inner sides 35 and 36 are facing the lateral sides 37 and 38 of the spacer holding unit 10 and when secured with the self-drilling galvanized steel screws 29 and 30, result in the assemblage of a permanent formwork 40 with flat external cementitious surfaces, which is ready for painting once the concrete poured within such formwork is cured and the concrete structure is made.

Figure 15:
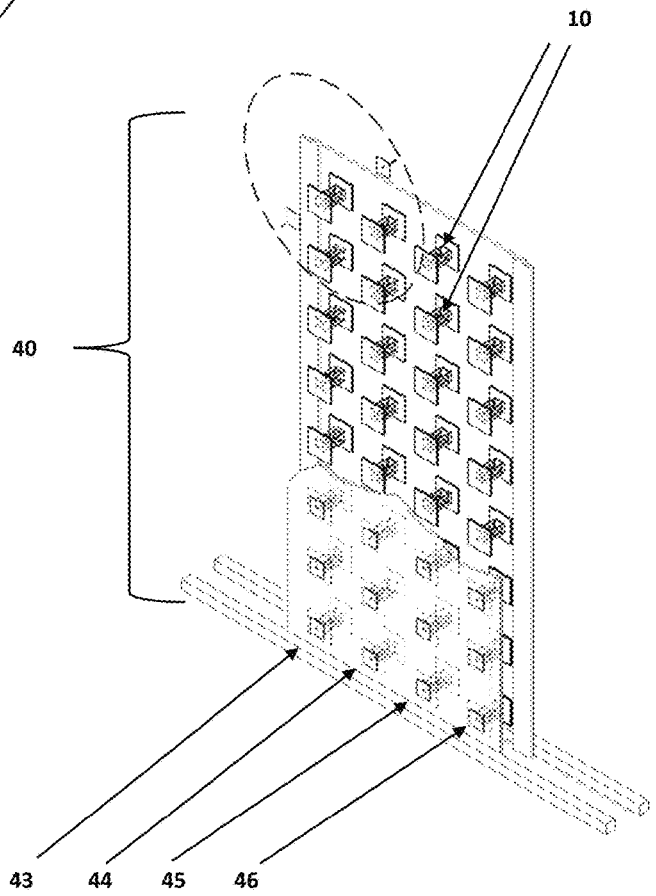
FIGS. 15 and 16 illustrate a full view of a formwork, as well as a closer view of a small section of a formwork, assembled using the secure holding spacer units according to the instant invention, wherein part of the front section of the formwork have been cut off in order to show the internal details of one particular distribution of the secure holding units within a formwork.
Figure 16:
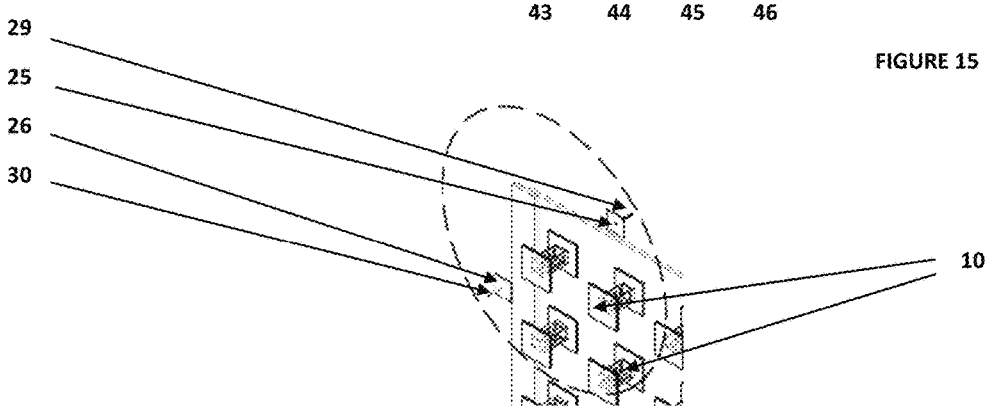

The physical structure of the holding spacer unit 10 has been created exclusively to render concrete permanent formworks that can endure the internal pressure produced by the liquid concrete mixture. Furthermore, a predetermined quantity of holding units 10 is accommodated, as shown in FIGS. 15 and 16, within the internal cavity 39 of the formwork, in an arranged pattern that only occupies near two percent of the internal cavity of the formwork. Therefore, near ninety eight percent of the concrete mixture poured in the internal cavity 39 of the formwork will be in direct contact with itself, which produce extremely strong concrete structures, capable to resist the weight of additional structures above them, thus allowing the construction of high concrete structures, such as buildings. Furthermore, the particular distribution pattern of the holding spacer units 10 at the interior cavity 39 of the formwork and the small thickness of the structure of the holding spacer units 10 allows an accommodation or settlement of horizontal and vertical construction rods 41 and 42 at a given and predetermined distance specified by the structural design or the construction plans and specifications, in such a manner that the insertion of electrical and/or other needed mechanical features within the formwork, is free of any interferences with the holding spacer units 10. Similarly, the resulting concrete structures are much more resilient to earthquake motions and similar factors, thus are stronger and safer. Besides, the use of a holding spacer unit 10 having a central main body, allows the incorporation or internal reinforcements, if necessary or desired, thus increasing the versatility or the herein disclosed formworks.

FIG. 14 illustrate typical cementitious panels or boards 31 and 32. The required cementitious panels 31 and 32 are commercially available from numerous companies, brands and characteristics, and may be substituted by any other suitable and similar panels.

FIGS. 15 and 16 illustrate a stay-in-place or permanent construction formwork embodiment design, wherein the upper front section of such particular formwork has been cut off, in order to illustrate the internal components placed in one particular distribution in the interior of the formwork.

The embodiment comprises two fiber cement panels 31 and 32, positioned parallel one to the other, wherein each fiber cement panel 31 and 32 have a flat substantially uniform external surface 33 and 34 and a flat and substantially uniform internal surface 35 and 36.

As illustrated in FIGS. 15 and 16, the holding spacer units 10 are accommodated in pattern on a series of multiple columns 43, 44, 45 and 46. Each of said columns 43, 44, 45 and 46 is apart from the next one at a predetermined distance. Similarly, each holding spacer unit 10 within a given column is also apart from the next holding unit 10 at a predetermined distance. The holding spacer units 10 are then sandwiched between the two cement panels 31 and 32 and secured to the formwork by inserting the self-drilling galvanized steel screws 29 and 30 in the small pre-drilled holes of the squared shape metal plates 25 and 26, passing them through such holes and drilling them across the cementitious panels 31 and 32, until the galvanized steel screws 29 and 30 reach and also penetrate, the lateral plastic sides of the holding secure unit.

While the invention has been described in conjunction with some embodiments, it is to be understood that many alternatives, modifications, and variations will be apparent to those skilled in the art in light of the foregoing description. Accordingly, the invention is intended to embrace all such alternatives, modifications and variations killing within the spirit and scope of the appended claims.

What is claim is:

1. A secure holding spacer unit configured to secure and keep together first and second fiber cement boards or panels for assembly of permanent formworks, said secure holding spacer unit comprising:

an elongated central part with a rectangular cuboid form having a rectangular-shaped front facet, a rectangular-shaped rear facet, a rectangular-shaped bottom facet, a square-shaped left facet, a square-shaped right facet, and a completely opened rectangular-shaped top facet, wherein each of said front facet, rear facet, and bottom facet has a plurality of holes and said left facet and right facet have no holes, wherein said left facet further comprises a left lateral side plate having a size greater than a size of said left facet and said right facet further comprises a right lateral side plate having a size greater than a size of said right facet so that said elongated central part, said left lateral side plate and said right lateral side plate define a single-piece unit of unitary construction; and a left exterior plate configured to connect the first fiber cement board or panel to said left lateral side plate with a first self-drilling screw and a right exterior plate configured to connect the second fiber cement board or panel to said right lateral side plate with a second self-drilling screw.

2. The secure holding spacer unit of claim 1, wherein the lateral side plates of said left and right facets have a square shape with the same size.

3. The secure holding spacer unit of claim 1, wherein said self-drilling screws are made of galvanized steel.

4. The secure holding spacer unit of claim 1, wherein said front facet, said rear facet, said bottom facet, said left facet, and said right facet form an empty cavity.

5. The secure holding spacer unit of claim 1, wherein said holding spacer unit is made of a plastic material.

6. The secure holding spacer unit of claim 1, wherein said front facet, said rear facet, and said bottom facet have the same size.

7. The secure holding spacer unit of claim 1, wherein one hole of said plurality of holes is bigger than the rest of said plurality of holes.

8. The secure holding spacer unit of claim 1, wherein said front facet, rear facet, and bottom facet each have five holes.

9. The secure holding spacer unit of claim 1, wherein said lateral side plates are made of plastic.

10. The secure holding spacer unit of claim 1, wherein said plurality of holes comprises one oblong-shaped hole.

11. The secure holding spacer unit of claim 10, wherein said one oblong-shaped hole is provided in the middle of said front facet, said rear facet, and said bottom facet.

12. The secure holding spacer unit of claim 1, wherein said plurality of holes comprises circular-shaped holes.

13. The secure holding spacer unit of claim 12, wherein said circular-shaped holes have the same size.

14. The secure holding spacer unit of claim 1, each exterior plate having a pre-drilled hole extending therethrough for receipt of a respective said self-drilling screw.

15. The secure holding spacer unit of claim 14, wherein said pre-drilled hole is provided on a center of the exterior plate.

16. The secure holding spacer unit of claim 14, wherein the left and right exterior plates have a square shape.

17. The secure holding spacer unit of claim 14, wherein said left and right exterior plates are made of metal.

18. A secure holding spacer unit configured to secure and keep together first and second fiber cement boards or panels for assembly of permanent formworks, said secure holding spacer unit comprising:

an elongated central part with a rectangular cuboid form having a rectangular-shaped front facet, a rectangular-shaped rear facet, a rectangular-shaped bottom facet, a square-shaped left facet, a square-shaped right facet, and a completely opened rectangular-shaped top facet, wherein each of said front facet, rear facet, and bottom facet has a plurality of holes and said left facet and right facet have no holes, wherein said left facet further comprises a left lateral side plate having a size greater than a size of said left facet and said right facet further comprises a right lateral side plate having a size greater than a size of said right facet so that said elongated central part, said left lateral side plate and said right lateral side plate define a single-piece unit of unitary construction; and a left exterior plate configured to connect the first fiber cement board or panel to said left lateral side plate with a first self-drilling screw and a right exterior plate configured to connect the second fiber cement board or panel to said right lateral side plate with a second self-drilling screw, each exterior plate having a pre-drilled hole extending therethrough for receipt of a respective said self-drilling screw.

19. The secure holding spacer unit of claim 18, wherein said front facet, said rear facet, said bottom facet, said left facet, and said right facet form an empty cavity.

20. The secure holding spacer unit of claim 18, wherein one hole of said plurality of holes is bigger than the rest of said plurality of holes.

21. The secure holding spacer unit of claim 18, wherein said front facet, rear facet, and bottom facet each have five holes.

22. The secure holding spacer unit of claim 18, wherein said plurality of holes comprises one oblong-shaped hole.

23. The secure holding spacer unit of claim 18, wherein said plurality of holes comprises circular-shaped holes.

* * * * *